US007383674B2

(12) United States Patent
Van Eenoo

(10) Patent No.: US 7,383,674 B2
(45) Date of Patent: Jun. 10, 2008

(54) SYSTEM FOR PACKAGING TABLETS IN A BLISTER STRIP WITH INTERCHANGEABLE DISTRIBUTION UNITS

(75) Inventor: Denis Van Eenoo, Vineuil (FR)

(73) Assignee: E.P.M.O., La Chaussee-Saint-Victor (FR)

( * ) Notice: Subject to any disclaimer, the term of this patent is extended or adjusted under 35 U.S.C. 154(b) by 0 days.

(21) Appl. No.: 11/372,258

(22) Filed: Mar. 10, 2006

(65) Prior Publication Data

US 2006/0201109 A1 Sep. 14, 2006

(30) Foreign Application Priority Data

Mar. 11, 2005 (FR) ..... 05 02426

(51) Int. Cl.
*B65B 59/04* (2006.01)
*B65B 5/12* (2006.01)
*B65B 39/00* (2006.01)

(52) U.S. Cl. ..... 53/201; 53/246; 53/250; 53/559; 141/144; 141/238; 221/167; 221/199

(58) Field of Classification Search ..... 53/168, 53/201, 235, 244, 246, 249, 250, 559, 561; 141/144, 237, 238; 221/162, 167, 168, 199; *B65B 59/04*
See application file for complete search history.

(56) References Cited

U.S. PATENT DOCUMENTS 2,523,517 A * 9/1950 Potter ..... 53/168
3,283,475 A * 11/1966 Pinto ..... 53/250
3,464,182 A 9/1969 Nichols
3,724,165 A 4/1973 Nichols
4,520,612 A * 6/1985 Muller ..... 53/201
4,733,520 A 3/1988 Rabbi
6,497,083 B1 * 12/2002 Garwood et al. ..... 53/244
6,510,676 B1 * 1/2003 Gauthier ..... 53/246
6,568,151 B2 * 5/2003 Buckley et al. ..... 53/249
6,598,370 B2 * 7/2003 Baroncini ..... 53/235
6,648,575 B2 * 11/2003 Baroncini ..... 53/235
6,675,555 B1 * 1/2004 Monti ..... 53/201
7,104,029 B2 * 9/2006 Tassin et al. ..... 53/201

FOREIGN PATENT DOCUMENTS

EP 1170209 A1 * 1/2002
EP 1170212 A2 * 1/2002
FR 2 759 346 8/1998
FR 2 759 668 8/1998
FR 2 759 669 8/1998

* cited by examiner

*Primary Examiner*—Stephen F. Gerrity
(74) *Attorney, Agent, or Firm*—Oliff & Berridge, PLC

(57) ABSTRACT

An installation for packaging tablets in a blister strip moving beneath a bulk feed device for tablets, the installation includes a distribution system comprising a mounting stand (1) for motorized control elements which has an attachment surface (100) provided with at least two sets of fixing members (41, 42) for detachably mounting thereon at least two interchangeable distribution units, each in working relationship with at least some of said motorized control elements in order to drive corresponding parts to execute the distribution of the tablets between the bulk feed device and the blister strip. Such interchangeable units may preferably include at least one dispersion-based distribution unit with rotating brushes in succession above the travel path of the blister strip, and at least one channel-based distribution unit with descending guide ramps for the tablets.

19 Claims, 3 Drawing Sheets

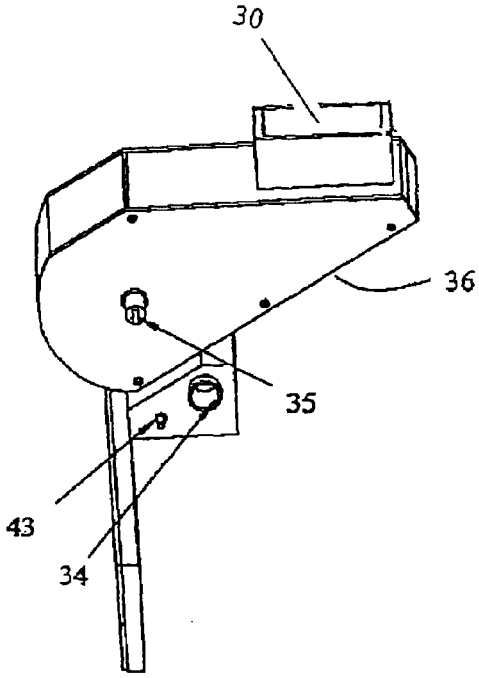
Figure 3A
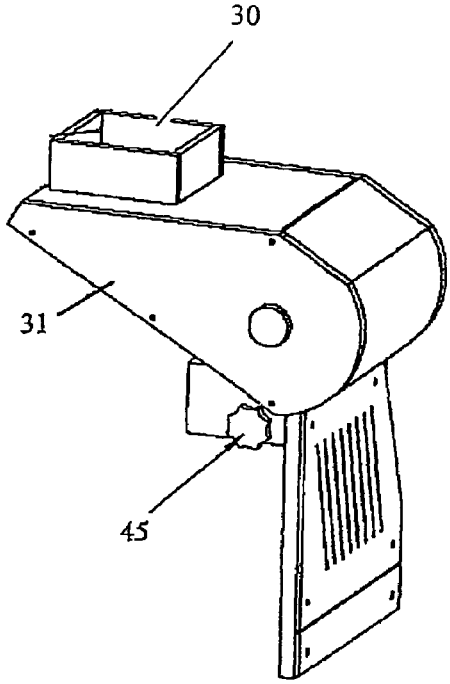
Figure 3B
Figure 4
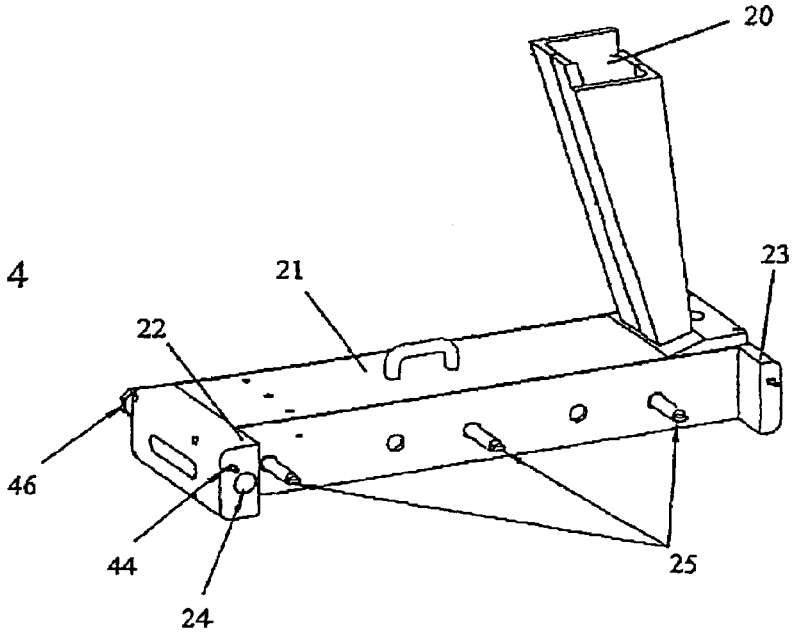

SYSTEM FOR PACKAGING TABLETS IN A BLISTER STRIP WITH INTERCHANGEABLE DISTRIBUTION UNITS

The present invention relates to equipment used in the field of packaging of tablets, meaning thereby any kind of products appearing in the form of separate units, when such tablets are packaged as dispensed in the holes, or so-called cells, of a blister receiver, generally referred to herein by the term "blister strip".

In the prior art, especially considering the pharmaceutical industry, numerous packaging installations are known by which tablets or equivalent units can be disposed in the bubbles of a moving blister. strip, driven to travel continuously beneath a feed device delivering the tablets in bulk. The tablets are thus dispensed, for example, into the bubbles of thermoformed cards in a synthetic material sheet receiving, at another station, a closing film (for example a protective aluminum film), as is described, for example, in U.S. Pat. No. 3,464,182. On the one hand, blister packaging machines of this type, in which the advancement of the strip is continuous (as is chosen, by way of example, in the remainder of the description so as better to illustrate the invention), and, on the other hand, machines in which the advancement of the strip is discontinuous at the level of the depositing of the tablets, which is carried out by successive batches (as in the system described in French patent application 2 759 669), are known.

The known installations can be broken down into two large families, differentiated by the means of distribution of the tablets between the bulk feed device and the blister strip, depending on whether the procedure entails agitation and dispersion in rotary-brush distributors, or guidance of the tablets along ramps in so-called channel-based distribution devices. Distributors of each type form the subject, for example, of French patent applications FR 2 759 346, FR 2 759 668, FR 2 759 669, or of American patents U.S. Pat. No. 3,724,165 and U.S. Pat. No. 4,733,520, which describe in all desirable detail their constitution and functioning for particular concrete embodiments.

A constraint which is commonly encountered with known installations is the need to be able to handle tablets of different formats. In the pharmaceutical industry, in particular, these formats are very varied, with pills, capsules and other tablets, which differ in size, shape, surface structure. Modern blister packaging factories must therefore have several machines and adjust them specifically to each change in quality of tablets to be handled. In particular, while an equipment which deposits tablets on the moving strip at the level of a case supporting rotating agitation and dispersion brushes allows a filling of the bubbles for tablets of rounded format to be optimally executed, such a filling method becomes impracticable for tablets having a more elongated or rectangular, or flatter shape. For these latter formats, it is generally necessary to use one of the ramp distribution methods by which the tablets can be prepositioned.

BRIEF DESCRIPTION OF THE INVENTION

The object of the present invention is essentially to improve the blister packaging conditions for tablets, hence, in particular, to reduce the construction and operating costs, to facilitate the handling of tablets of varied formats in a same installation, to increase the production rate. It manages to avoid the drawback of existing installations in which a plurality of specific heavy equipments are used, which have to be mounted on and removed from the packaging line each time the method of distributing or dispensing the tablets changes, and in which the mounting/removal operations take up a lot of time and bring a halt to the packaging, which damages productivity.

To this end, the invention proposes a modular tablets distribution system for the packaging of tablets in a blister strip moving beneath a bulk feed device for the tablets, in which a mounting stand for motorized control elements has an attachment surface provided with at least two sets of fixing members for the detachable mounting, respectively, of at least two interchangeable distribution units, each in working relationship with at least certain of said motorized control elements in order to drive specific means of its own to execute the distribution of the tablets between the bulk feed device and the blister strip.

Said interchangeable units preferably comprise at least one so-called dispersion-based distribution unit, having rotating brushes in succession one after the other above the travel path of the blister strip, and at least one so-called channel-based distribution unit having guide ramps down to the blister strip for depositing the tablets one by one in aligned cells of the blister strip.

The system of the invention allows an interchangeability between different distribution configurations owing to the detachability from the stand of the distribution elements in contact with the tablets. It is therefore no longer necessary to carry out a tiresome removal of the whole of the distribution equipment. Moreover, it is made easier to conform to the purity conditions demanded in the pharmaceutical field by avoiding contamination between tablets of different chemical compositions handled successively in a same machine.

The different elements making up the different interchangeable units fit on the stand in such a way as to be able to work to distribute the tablets from the upper bulk feed device down to the plane of travel of the blister strip. The attachment surface of the stand therefore advantageously has a vertical component wall such as to be able to support equipments extending from one to the other. It is configured to receive the different distribution elements alternately, in a detachable manner, even though they are either in an inclined arrangement between two levels of different heights above the travel path of the blister strip, as in a channel-based unit in ramps guiding the descent of the tablets by gravity, or in a low arrangement longitudinally above that path, as in a distribution housing with rotative agitation and dispersion brushes for the tablets. Such a brush housing, which is preferably itself of the interchangeable brushes type as described in the text of patent FR 2 759 346, is advantageously supplemented by a tablet intake chute connecting to the bulk feed device, whereby the same mounting base for the latter, as well as the same drive means for the blister strip, can be maintained when the distribution method is changed.

In order to suit a maximum number of distribution methods, the stand with its attachment surface is preferably adapted to receive and support alternately channel distribution units with guide ramps of several different types. These can be selected in particuliar from those in which the ramps are inclined practically upright in order that the tablets run down them easily by gravity, or those in which the ramps are less inclined but subjected to vibrations promoting the descent of the tablets, or those in which the tablets are introduced into the guide ramps starting from the bulk feed device by bladed rotary systems or by vibrating distributors, as described in the texts of previously cited patents, or else those in which the ramps are formed by channels groved around a cylinder which is driven around it axis to make the tablets fall, its axis being preferably transversal to the blister strip.

According to another of its advantageous features, the modular system according to the invention contains rotary drive members actuated via motorization elements borne by the stand, which are accessible through the attachment surface of the latter so as to connect detachably to the different rotary elements of the distribution units. Such members are advantageously disposed at least two distinct height levels in order at a first height level, or higher or upper level, to rotate the axle of at least one rotary element of the gravity-based ramp distribution unit, and at a second height level, or lower level since lower than the first height level, to rotate the axle of at least one rotating brush belonging to the dispersion-based distribution housing.

According to another feature, the attachment surface of the stand is constituted by a forward side of an attachment wall which is preferably vertical orthogonal and adjacent to a drive device for the horizontally moving blister strip, and a set of fixing members comprises at least two fixing points, which are distanced apart in the direction of displacement of the strip so as to allow what can suitably be referred to as a brush housing, namely the main rotating brushes for agitating and dispersing the tablets with their support, to be mounted in a dispersion-based distribution unit, by disposing it horizontally in low position above the moving blister strip, such that the rotating agitation and dispersion brushes make contact therewith. Particularly for the useful elements in this distribution method, but, if necessary, also for those of the channel-based distribution units, it is advantageous that the members for fixing the elements on the stand, by screwing or otherwise, be configured so as to allow a relative position adjustment between the elements and the blister strip and/or between the elements each other. The flexibility of a brush housing can thus be fully exploited, in that it allows tablets which are all round in shape, but more or less elongated or flat, and which, above all, can vary in size from one production batch to another, to be handled alternately.

According to another feature, there are advantageously provided independent fixing members for the mounting of a tablet-laying brush for laying the tablets deposited on the blister strip down in the cells thereof (thus disposed to operate in the plane of the receiving blister strip) or of a helically threaded brush used to push the surplus tablets aside from the blister strip after the cells available therein have been filled downstream the descending channel-based distribution ramps or downstream a brush housing. The fixing members provided on the attachment surface of the stand are disposed in correspondance with the relative arrangements of the alternate distribution elements resulting therefrom.

According to the invention, the means for fixing the elements of the distribution units on the stand are chosen so as to promote mounting and removal operations, which are thence easy and rapid. The same applies to the connecting means which perform the connection between, on a same forward side of the attachment wall as the traveling strip, the axles of the rotating brushes and other rotary driven elements, and the drive shafts of the motorization elements mounted in the stand on the opposite backward or rear side of the attachment wall. From this point of view, screwdriver-type means are preferably employed, which work by fitting a member having a male connector axially into a cooperating member having a female connector, said male and female connectors engaging each other through the wall forming the attachment surface.

Other motorized control members are advantageously provided to complement the system according to the invention in order to execute, through the attachment surface wall of the stand, an automatic actuation of the elements of the distribution units which are in need thereof. The same is true, in particular, of sensors which are sensitive to the level reached by the tablets mass and which form part of a control circuit for the intake of the tablets at the inlet of a brush-type distribution housing with brushes operating on the surface of the relative displacement strip.

According to other characteristic features of the invention, the mounting system of the interchangeable distribution units is designed to facilitate a rapid adjustment of the elements of which they are respectively composed. It is known, in fact, that in order to adapt the installation to the handling of each type of compounds it is desirable not only to modify the composition of the distribution unit, but also to act upon the working parameters of the different elements involved in the distribution of the tablets in order to make them advance along the whole path from the bulk feed arrangement to the blister strip and arrange each in a blister cell. And since a same installation is generally made periodically to resume the handling of different ranges for compounds of a specific type, it is useful to record the parameters appropriate to each type of compounds in order to reuse them in each cycle and thus avoid the trial-and-error exercises demanded by their adjustment whenever a hitherto unknown type of compounds is first handled.

To this effect, the invention advantageously provides for equipping the stand with sensors for detecting which model of distribution element has just been mounted in a location appropriate to its functioning on the attachment surface wall and means for transmitting the information to a master control computer of the installation which has memory means for registering previously determined data and computer means for automatically calculating what motorization elements should thence be activated and for producing actuation signals to start them operating in consequence.

Moreover, it is advantageous that for each distribution method, in the memory means of the control computer there are recorded several sets of working parameters previously defined in association with the adjustment facilities suitable for each particular type of compounds to be handled. The computer is then programmed so as to automatically select the sets of recorded parameters in relation with the distribution elements whose presence has been detected by the sensors, and to supply relevant information concerning them to an operator who will then be able to use the information to select the appropriate set from a series displayed to him and give the order for automatic use of the corresponding parameters.

The parameters needing adjustment that can thus be memorized preferably comprise at least the rotation speeds for the different rotating elements, and among them, notably, the agitation and dispersion brushes of a brush housing, the revolving drum of a rotary distributor, the bladed cylinder of a tablet-dispensing apparatus at the inlet to a descending ramp element, the auxiliary brushes serving to lay down flat tablets or to remove surplus tablets and debris, as well as the working powers serving to set in motion the vibrating elements, for example in order to adjust the flow of the tablets via their speed along a vibrating ramp element.

DESCRIPTION OF THE DRAWINGS

The invention, with its characteristics and advantages, will emerge more clearly from a reading of the description which will now be provided with reference to the following drawings, in which:

FIGS. 3A and 3B represent respectively, in perspective, a distribution ramp unit connectable to the stand of FIG. 2;

FIG. 4 represents a perspective view of a distribution housing connectable to the stand of FIG. 2;

DETAILED DESCRIPTION OF PREFERRED EMBODIMENT

Figure 2:
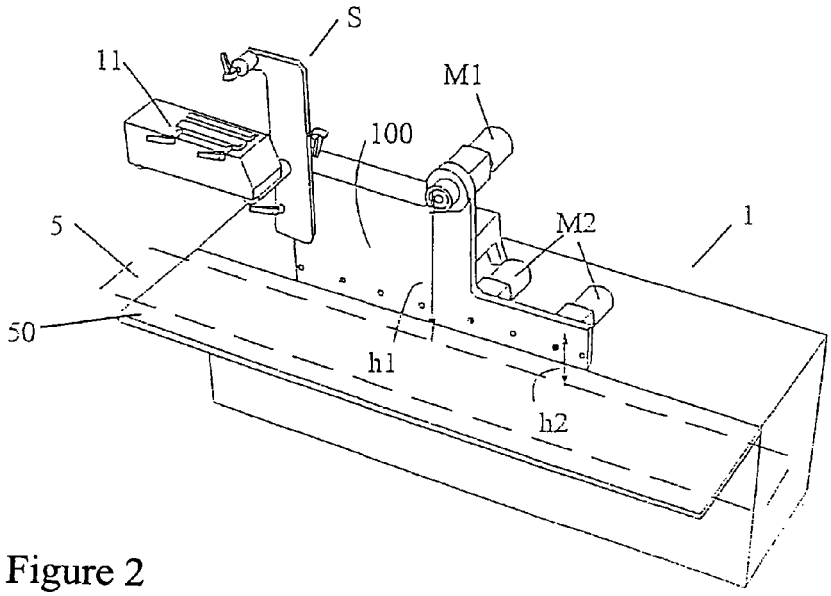
FIG. 2 represents, in perspective, an embodiment of a stand capable of being configured according to different distribution methods.

In the example chosen to illustrate the invention, the invention is applied to the distribution of tablets in a blister packaging installation for pharmaceutical tablets. The tablets are individually received in the cells of a blister strip (5) driven in a continuous translational motion. The modular system comprises a stand (1) equipped with motorization elements (M1, M2) for setting in motion rotative brushes (B1 FIG. 5, B2 FIG. 6) coming above the travel path of the strip (5) with their axes transversal to said path. As illustrated in FIG. 2, the stand can comprise or be connected to a horizontal displacement device (50) for the blister strip (5).

The stand comprises at least one attachment surface which is materialized by a standing wall, more specifically a vertical plate (100), here disposed orthogonal and adjacent to the blister displacement device. The stand (1) likewise comprises a bracket unit (S) for supporting, at an upper level in height relative to the moving strip (5), a bulk feed device illustrated by a tablet supply platform (P). That platform is directed transversal to the moving direction of the blister, as on FIG. 1, or parallel to it as on FIG. 2.

The plate (100) is equipped with at least two sets of fixing members (41, 42) by which, respectively, a gravity-based channel distribution unit (3), with descending distribution ramps, and a substantially horizontal brush housing (2), combined with a chute (20), can be fixed on the stand, on its attachment surface wall. These dispensing and distribution means are detachably fixed to the attachment surface (100) of the stand, such that it is possible easily to perform, even without tools, a rapid mounting or removal of the dispensing and distribution means specific to a format of tablets. The specific shape of the distribution modules can be very variable, insofar as they have fixing elements tailored to the stand (1) which allow rapid mounting, these modules being coupled to the stand by one and/or other of the two sets of fixing members (41, 42) of the attachment surface (1) illustrated in FIG. 1.

The modular system according to the invention, such as described, allows the upper platform (P) to be fixed by rapid fixing means (11), as illustrated in FIG. 2. The bracket unit (S) is adjustable in position considering vertical height and/or transversal depth. This bracket unit (S) is connected to the attachment surface (100) of the stand (1), for example, by adjustable screwing or clamping means, which enable on the one hand, to have the bracket unit (S) be moved laterally closer to or away from the attachment surface (100) of the stand, and enable on the other hand, this bracket unit (S) to be lowered to a greater or lesser extent. The positional adjustment of the bracket unit (S) is realized, for example, by respective thumbwheels (15, 16), one thumbwheel serving to adjust the height and the other to adjust the depth. A tablet-arrival sleeve (10) upstream of the platform (P) can additionally be fastened to the bracket unit (S) by means (17) which execute the fixing and height adjustment of this sleeve (10). The platform can also be adjusted for intake in the transverse direction (FIG. 1) or intake in the longitudinal direction (FIG. 2).

The platform (P) can contain a tablet supply rail for delivering the tablets into a feed chute (20, 30) toward the dispensing means (2, 3) for these tablets. The platform (P) can contain, in its downstream section, a suction system for evacuating fragments of the broken products or the powder which can result from the rubbing and impacts of the products one against the other. The downstream end of the platform is disposed above the upstream end of the tablet dispensing means (2, 3). These dispensing means are described below.

With reference to FIGS. 3A and 3B, the system according to the invention can be configured for specific non-rounded formats by receiving, in a detachable manner, a unit (3) with descending distribution ramps, the ramps being vibrating or fixed. This unit (3) comprises a guide (32) having longitudinal grooves (33) forming tablet guiding ramps on its surface. The tablets can thus be deposited and orientated in the desired manner by falling into ramps of the guide (32) digged inside it. A hopper (31) is provided in this distribution unit (3) to receive the tablets arriving via the tablet intake chute (30) provided. As a variant, a plurality of chutes can be provided. The hopper (31) comprises a part or slope (36) which is inclined downward in the direction of its downstream section and which can form one or more feed chutes for the ramps of the vertical guide (32), this guide (32) being situated downstream of the hopper (31).

In one embodiment of the invention, at least one wall of the feed chutes disposed in the hopper (31) is configured such as to form a funnel or constriction in the direction of the vertical guide (32). Constrictions are provided, for example, for a plurality of inclined chutes and are configured so that, in the downstream section of each chute, the tablets can only be orientated longitudinally relative to a longitudinal axis of symmetry of the chutes and disposed one behind the other.

Figure 5:
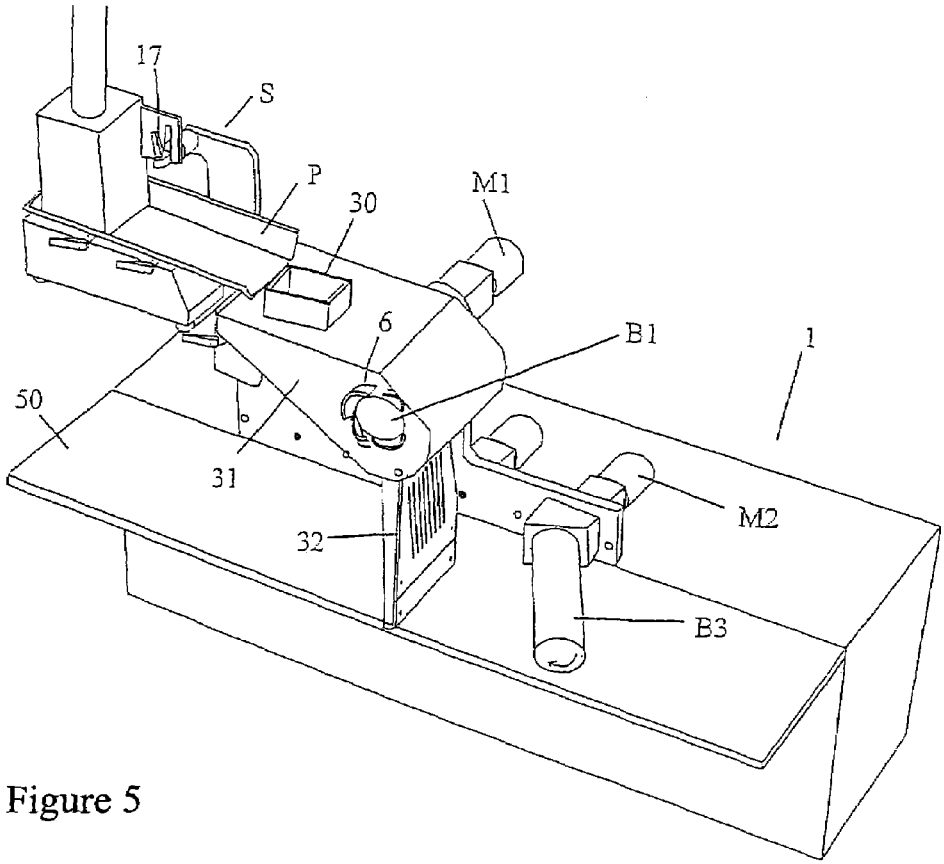
FIG. 5 shows an example of a system according to the invention having a configuration comprising a distribution housing.
Figure 6:
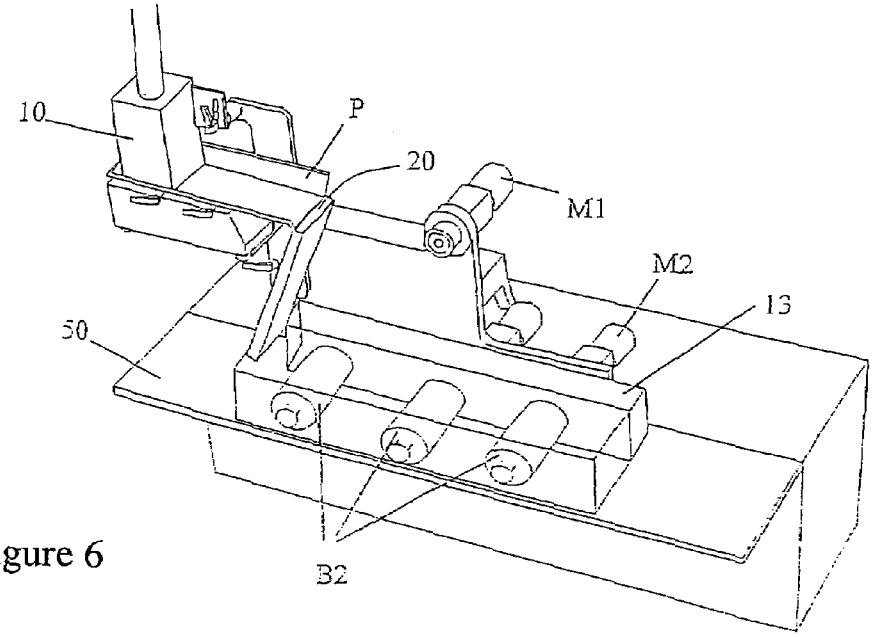
FIG. 6 shows an example of a system according to the invention having a configuration comprising a distribution ramp.

As illustrated in FIG. 5, the hopper (31) forms a closed inner volume in which there is incorporated a bladed brush (B1), that is to say a revolving cylinder with flexible radial vanes. This bladed brush (6) is disposed above the vertical guide (32). The axis of the cylinder of the brush (B1) is transversal and more particularly perpendicular to the longitudinal axis of symmetry of the inclined slope (36). The cylinder, which contains, for example, four flexible vanes, is rotatively driven in a specific direction (clockwise in the case of FIG. 5), in which it repels part of the tablets in the direction opposite to their progression toward the vertical guide (32).

Figure 1:
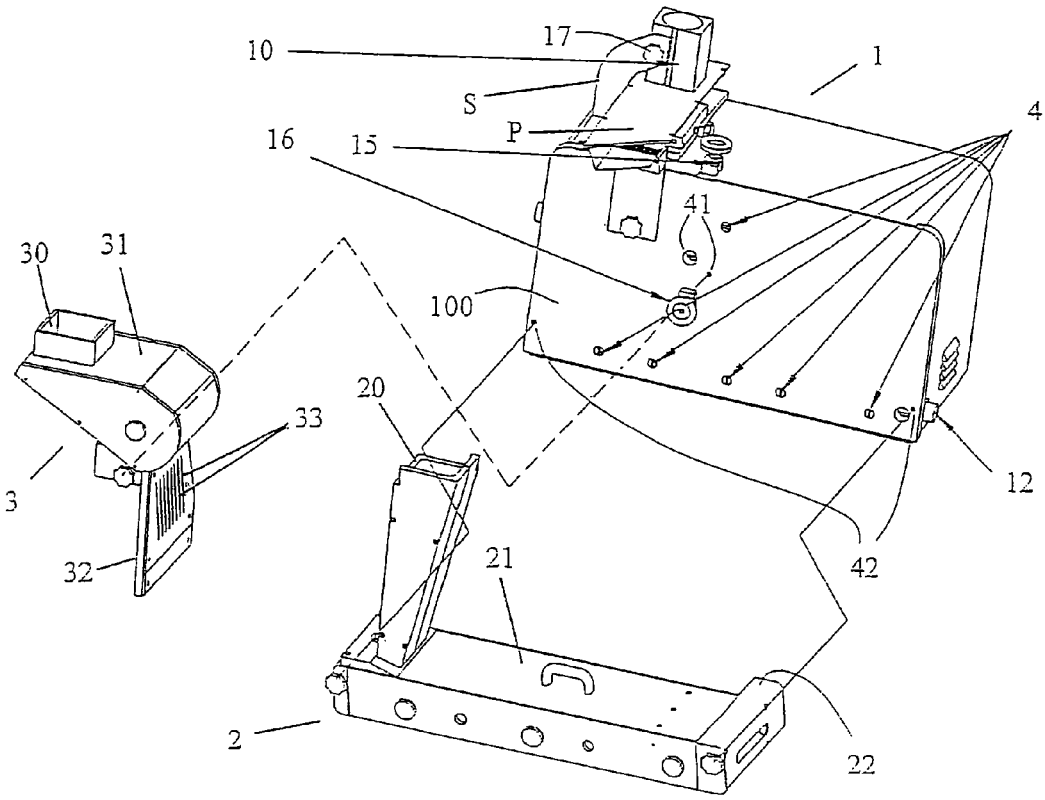
FIG. 1 represents, in perspective, an embodiment of the modular distribution system according to the invention.

As represented in FIG. 1, the attachment surface wall of the stand (1), i.e. the plate (100), supports at an upper level, in a high situation compared to the blister strip plane, at least one fixing member (41) as well as at least one coupling member of the male type or the female type. This coupling member, comprised, for example, of a female connector groove or slot (4), is disposed in height relative to the blister strip (5), in a position for connection with a part (35) that extend along with the axle of the rotating brush (B1) and forms thereby a cooperating male connector for connection with a motor (M1) or rotary drive elementy situated supported by the stand at same level.

The radial-vaned cylinder can execute an adjustment of the flow of tablets conveyed in the inclined chutes, by only allowing one tablet at a time to pass into the downstream section of the chutes. The vaned cylinder dispels rearward all the superposed tablets and only lets pass downstream that tablet which is situated at the bottom of the hopper (31). Of course, at the exit from the hopper, as many inclined chutes can be provided as there are vertical ramps in the guide (32). The ramps which are formed by means of longitudinal grooves (33) are situated in a plane perpendicular to the longitudinal axis of symmetry of the strip (5).

In one embodiment of the invention, a dust-suction system (34) can be disposed at the level of the inclined slope (36) in order to suck up and evacuate the fragments of broken tablets or the powder which can result from the rubbing or impacts of the products upon each other. In the vertical ramps, the tablets retain the orientation they have acquired. Detection means (16), optical means for example, can be provided in the distribution unit (3) to detect the filling level of the vertical guide (32).

According to the present invention, the descending ramp distribution unit (3) is easily fixed on at least one attachment surface (100) of the stand by a rapid coupling device, for example of the screwdriver type, in order to connect the bladed brush (B1) to a motorization element (M1), fixing and centering elements (43) being provided to facilitate the mounting/removal operations. The screwdriver-type rapid couplings are designed to cooperate each with a turning slot disposed on said attachment surface (100) of the stand (1). A knurled screw with rapid fastening, disposed on the side opposite to the side by which the distribution unit (3) is fixed to the stand (1), allows the user to mount and remove this unit (3) without tools and with great speed.

As illustrated in FIG. 5, a tablet-laying brush (B3) is disposed above the moving blister strip (5), downstream of the unit (3) with descending distribution ramps. The placement of the tablets in correct position inside the cells of the strip (5) is thus facilitated by laying them down if needed. Another brush can be provided, instead the laying brush or in addition to it, to push aside any extra tablet not entering a cell or crushed debris.

The modular system according to the invention can incorporate another type of interchangeable distribution equipment, for example in the form of a case securing, in a direct and random manner, the insertion of rounded-format tablets into the cells of the strip (5). With reference to FIG. 4, the system can contain a detachable distribution housing (2) covering a part of the moving strip (5). In the embodiment of FIGS. 1 and 4, the distribution housing (2) is composed of a case (21), which is open in its bottom section, and a distribution chute (20). The chute (20) directs the discharged tablets from the platform toward the interior of the case (21). This case (21) contains, for example, between two and five brushes (B2) in a parallelepipedal volume. The respective axles of the main brushes (B2) of the distribution unit extend out of the main housing to form a part of screwdriver-type rapid couplings. It is assumed, for example, that they are male parts (25, FIG. 4), equipped with a substantially rectangular connector capable of engaging in a complementary groove (4, FIG. 1).

As illustrated in FIG. 4, the case (21) can comprise fixing and centering elements (44), for example disposed at each end of the case (21) and orientated toward the attachment surface (100). These elements (44) are of the rapid-handling type and can simply consist of male elements, while a series of fixing members (42) comprising female-type fixing points, for example at least two fixing points, is provided in the attachment surface (100) to allow the distribution housing (2) to be fixed horizontally just above the moving strip (5). The manipulation of these elements (44) can be realized using knurled screws (46), the user having merely to operate two thumbwheels (46), as illustrated in FIG. 1, to attach the distribution housing (2) to the stand (1). The rapid couplings between male parts (25) prolonging the axle of the brushes (B2) engage automatically in this case in the associated grooves (4) in the stand (1).

In the example of FIGS. 1 and 4, the case (21) comprises lateral projections at both its ends (22, 23), such that the case (21) can be connected with a block (13) standing out from the rest of the attachment surfaces (100). This block (13, FIG. 6) receives the end of the axles of the brushes (B2) and allows them to be rotary driven, by virtue of independent motors (M2). A dust-suction port (12) is provided on the side of the stand (1) and can communicate with a dust-evacuation duct disposed in the projecting section of one end (22) of the case, as represented in FIG. 1.

With reference to FIG. 1, the attachment surface wall(s) (100) allowing the connection of the respective distribution equipments supports between four and eight screwdriver-type rapid couplings for fastening a respective drive member of the axle of the rotating brushes (B1, B2, B3) to motorization elements (M1, M2), constituted, for example, by independent motors.

The stand (1) used in the invention, as illustrated in FIG. 2, thus contains rotary drive members actuated by means of the motorization elements (M1, M2), which are advantageously disposed at least two distinct height levels (h1, h2). By virtue of this stand (1), the facility is therefore provided to rotate at a first height level, or higher level (h1), the axle of at least one rotating brush (B1) of the unit (3) with descending distribution ramps, and, at a lower level (h2), the axle of at least one rotating brush (B2) of said horizontal distribution housing (2). A drive member disposed at this second height level (h2) can be used to rotary drive a brush (B3) for laying down the tablets downstream the vertical guide (32) of the distribution ramp unit (3). That brush is optionally disposed and supported so that it can be used alternately as a similar laying brush downstream the main brush housing of the dispersion unit.

As has been described, the driving of the moving elements of the interchangeable distribution units takes place through the attachment surface wall, i.e. plate (100). In particular, the shafts of the drive motors have connectors which are accessible through this wall so as to attach to the axles of the rotary elements. Apart from the access facilities of this kind, this wall is advantageously continuous and solid. Moreover, each of the elements of the interchangeable units which are in contact with the tablets is separated from the stand (1) by an additional auxiliary vertical wall in front of the attachment surface wall. This allows, in particular, the brushes (B) to be isolated from the attachment surface (100) and serves to prevent a diffusion of the chemical compounds, which would provoke risks of contamination between different types of tablets used.

The invention claimed is:

1. A modular distribution system for packaging tablets in a blister strip moving along a travel line beneath a bulk tablet feed device and along a mounting stand having motorized control elements, wherein an attachment surface wall of the mounting stand is provided with at least two sets of fixing members for detachably mounting thereon at least two interchangeable distribution units that include different means for operating said distribution of tablets received from the bulk feed device and delivering the tablets to the blistering strip, and with means for setting each of the units when mounted on the attachment surface in working relationship with at least some of said motorized control elements that are adapted to drive elements of the distribution units.

2. The distribution system as claimed in claim 1, wherein said interchangeable units comprise at least one dispersion-based distribution unit having rotating brushes in succession above the travel line of the blister strip, and at least one channel-based distribution unit having guide ramps for guiding individual tablets in series in separate channels down to the blister strip, thereby depositing the tablets one by one in series in aligned cells thereof.

3. The distribution system as claimed in claim 2, wherein said stand with its attachment surface is adapted to receive and support alternately either one of the at least two interchangeable channel-based distribution units comprising guide ramps for the tablets that are inclined practically upright for letting the tablets run down them easily by gravity, guide ramps for the tablets that are less inclined but subjected to vibrations promoting the descent of the tablets, those in which the tablets are introduced into guide ramps from the bulk feed device by bladed rotary systems or by vibrating adjusting-plate-type distributors, or those in which guide ramps for the tablets are arranged around a cylinder which is rotary driven to make the tablets fall.

4. The distribution system as claimed in claim 2, comprising rotary drive members actuated via motorization elements supported by the stand, which are accessible through the attachment surface wall so as to connect detachably to respective rotary operation elements of either distribution units.

5. The distribution system as claimed in claim 4, wherein the rotary drive members are disposed at at least two distinct height levels along the attachment surface wall for entering alternately in rotative functional relationship, the two distinct height levels including a first higher level with the axle of at least one rotary element of the channel-based distribution unit, and a second lower level with the axle of at least one rotating brush belonging to the dispersion-based distribution unit.

6. The distribution system as claimed in claim 2, further comprising independent fixing members on the attachment surface wall for the mounting of a tablet-laying brush for laying the tablets deposited on the blister strip down in the cells thereof or of a helically threaded brush used to push the surplus tablets aside from the blister strip after the cells available therein have been filled downstream of descending guide ramps of the channel-based distribution unit or downstream a brush housing for rotating agitation and dispersion brushes of the dispersion-based unit, said fixing members being disposed in correspondence with the relative arrangements of the alternate distribution elements in said interchangeable units.

7. The distribution system as claimed in claim 2, wherein sensors are mounted on said attachment surface which are sensitive to the level of the tablets at the inlet of said removable dispersion-based unit and which form part of a control circuit for the intake of the tablets.

8. The distribution system as claimed in claim 2, wherein said stand is equipped with presence sensors on said attachment surface for detecting which of said at least two distribution units has just been mounted in a location appropriate to its functioning on the attachment surface wall and means for transmitting the information to a master control computer of the installation which has memory means for registering previously determined data and computer means for automatically calculating what motorization elements should thence be activated and for producing actuation signals to start them operating in consequence.

9. The distribution system as claimed in claim 8, wherein the memory means of the control computer is adapted to register several sets of working parameters previously defined in association with the adjustment facilities suitable for each particular type of compounds to be handled by each interchangeable distribution unit, and the computer is programmed to automatically select the sets of recorded parameters in relation with the distribution elements whose presence is detected by the sensors.

10. The distribution system as claimed in claim 9, wherein said parameters that can thus be memorized comprise at least the rotation speeds for rotating elements in each said interchangeable unit, including when appliable agitation and dispersion brushes in a dispersion-based unit, a revolving drum of a rotary distributor at the entrance of guide ramps in a channel-type unit, optional auxiliary brushes serving to lay down flat tablets or to remove surplus tablets and debris.

11. The distribution system as claimed in claim 10, wherein said parameters further include values for the working powers serving to set in motion a vibrating ramp element, thereby adjusting the flow of the tablets via their speed along the vibrating ramp element.

12. The distribution system as claimed in claim 1, wherein said attachment surface has a vertical component extending from said bulk feed device at an upper level down to a travel path of the blister strip at a lower level, and is adapted to removably support, alternately, either equipments disposed in an inclined arrangement between said upper and lower levels, belonging to a channel distributing unit having guide ramps guiding the descent of the tablets by gravity, or equipments disposed in a low arrangement longitudinally above said travel path of the blister strip, belonging to a dispersion-based distribution unit having rotative agitation and dispersion brushes for the tablets that are arranged in succession along the travel path of the blister strip above it.

13. The distribution system as claimed in claim 12, further comprising a drive device for moving a blister strip in a horizontal direction along said attachment surface wall and wherein a set of fixing members for the mounting of the dispersion-based distribution unit comprises at least two fixing points which are distanced apart in the direction of advancement of the strip on said attachment surface and are adapted for supporting thereon a brush housing of the dispersion-based distribution unit containing said rotative agitation and dispersion rotative brushes in functional relationship with the blister strip.

14. The distribution system as claimed in claim 13, wherein said fixing members are adjustable in their position on said attachment surface relative to the travel path of a blister strip entrained by said drive device.

15. The distribution system as claimed in claim 13, wherein a further set of fixing members adapted for the mounting of the channel type distribution unit comprises at least two fixing points which are distanced apart in the vertical direction above the travel path of the strip on said attachment surface and which are adjustably adapted for supporting thereon guide ramps for the tablets fed thereto from the bulk feed device.

16. The distribution system as claimed in claim 13, further comprising independent fixing members for the mounting of a tablet-laying brush for laying the tablets down in the cells of the blister strip and/or for the mounting of a helically threaded brush for pushing aside the surplus tablets or debris.

17. The distribution system as claimed in claim 13, wherein connecting means for performing connection between, on a same forward side of the attachment wall as the traveling strip, the axles of the rotating brushes and other rotary driven elements, and the drive shafts of the motorization elements mounted in the stand on the opposite backward or rear side of the attachment wall.

18. The distribution system as claimed in claim 17, wherein said connecting means are screwdriver-type means that work by fitting a member having a male connector axially into a cooperating member having a female connector, said male and female connectors engaging each other through the wall forming the attachment surface.

19. The distribution system as claimed in claim 13, wherein any element of the interchangeable units liable to come in contact with the tablets is separated from the stand by an additional auxiliary wall in front of the attachment surface wall.

* * * * *